US011585645B2

(12) United States Patent
Eberhart

(10) Patent No.: US 11,585,645 B2
(45) Date of Patent: Feb. 21, 2023

(54) BULLETS AND METHODS OF MAKING BULLETS

(71) Applicant: Olin Corporation, St. Louis, MO (US)

(72) Inventor: Gerald Todd Eberhart, Bethalto, IL (US)

(73) Assignee: Olin Corporation, St. Louis, MO (US)

( * ) Notice: Subject to any disclaimer, the term of this patent is extended or adjusted under 35 U.S.C. 154(b) by 277 days.

(21) Appl. No.: 16/233,077

(22) Filed: Dec. 26, 2018

(65) Prior Publication Data

US 2019/0277610 A1 Sep. 12, 2019

Related U.S. Application Data

(60) Provisional application No. 62/609,599, filed on Dec. 22, 2017.

(51) Int. Cl.

| | |
|---|---|
| ***F42B 33/00*** | (2006.01) |
| ***B22D 17/02*** | (2006.01) |
| ***B22D 17/22*** | (2006.01) |
| ***B22D 25/02*** | (2006.01) |
| ***F42B 12/34*** | (2006.01) |
| ***F42B 12/78*** | (2006.01) |
| ***B21K 1/02*** | (2006.01) |
| ***F42B 12/74*** | (2006.01) |

(52) U.S. Cl.

CPC ..... *F42B 33/00* (2013.01); *B21K 1/025* (2013.01); *B22D 17/02* (2013.01); *B22D 17/2263* (2013.01); *B22D 25/02* (2013.01); *F42B 12/34* (2013.01); *F42B 12/74* (2013.01); *F42B 12/78* (2013.01); *F42B 33/001* (2013.01)

(58) Field of Classification Search

CPC ..... F42B 12/00; F42B 12/02; F42B 12/34; F42B 12/74; F42B 12/76; F42B 12/78; F42B 30/02; F42B 33/00; F42B 33/001; F42B 33/02; B21K 1/02; B21K 1/025

USPC ..... 86/54–55

See application file for complete search history.

(56) References Cited

U.S. PATENT DOCUMENTS

| | | | | | |
|---|---|---|---|---|---|
| 4,793,037 | A * | 12/1988 | Carter | B21K 1/025 | 102/507 |
| 5,357,866 | A * | 10/1994 | Schluckebier | F42B 12/34 | 102/509 |
| 5,385,101 | A * | 1/1995 | Corzine | F42B 12/34 | 102/509 |
| 6,244,187 | B1 * | 6/2001 | Head | F42B 12/34 | 102/507 |
| 6,837,165 | B2 * | 1/2005 | Eberhart | F42B 12/74 | 102/510 |
| 7,059,234 | B2 * | 6/2006 | Husseini | F42B 5/02 | 86/55 |
| 8,256,352 | B2 * | 9/2012 | Masinelli | F42B 12/34 | 102/507 |
| 9,329,003 | B2 * | 5/2016 | Peterson | F41A 3/58 | |
| 2006/0124022 | A1 * | 6/2006 | Eberhart | F42B 12/34 | 102/508 |
| 2007/0131131 | A1 * | 6/2007 | Stock | F42B 12/34 | 102/510 |

(Continued)

*Primary Examiner* — Joshua E Freeman
*Assistant Examiner* — Benjamin S Gomberg
(74) *Attorney, Agent, or Firm* — Harness, Dickey & Pierce, P.L.C.

(57) ABSTRACT

A method of making a bullet includes metal injection molding a bullet jacket or preform, and forming the jacket or preform into a bullet.

3 Claims, 4 Drawing Sheets

(56) References Cited

U.S. PATENT DOCUMENTS

| | | | | |
|---|---|---|---|---|
| 2012/0111220 | A1* | 5/2012 | King | F42B 12/34<br>102/509 |
| 2017/0080498 | A1* | 3/2017 | Burrow | C22C 38/04 |
| 2017/0219325 | A1* | 8/2017 | Smith | F42B 12/74 |

* cited by examiner

BULLETS AND METHODS OF MAKING BULLETS

FIELD

The present disclosure relates to BULLETS AND METHODS OF MAKING BULLETS.

BACKGROUND

This section provides background information related to the present disclosure which is not necessarily prior art.

This invention relates to bullets and methods of making bullets.

Jacketed bullets are conventionally made by forming a cup-shaped jacket preform, inserting a core, and forming the jacket preform and core into a bullet. While this process is efficient and relatively inexpensive, it put certain limits or restrictions on the design of the bullet.

Embodiments of the present invention provide bullets and new methods of making bullets. Generally, a first preferred embodiment of a method of making a bullet according to the principles of this invention comprises metal injection molding a bullet jacket of a first material. The jacket comprises back, and a sidewall projecting forwardly and outwardly from the back. The sidewall has a rearward portion and a forward portion, with the wall thickness of the rearward portion increasing toward the forward portion, and the wall thickness of the forward portion decreasing toward the forward end. A core of a second material is inserted into the rearward portion of the sidewall. The jacket is formed around the core to form a bullet with a generally cylindrical rearward portion and a forward portion that tapers toward the forward end, with an open forward end. The juncture between the rearward portion of the jacket and the forward portion of the jacket impinges on and retains the core.

Preferably, a plurality of lines of weakness are formed in the forward portion of the jacket during the metal injection molding process. A tip can be disposed in the open forward end of the jacket.

Generally, a second preferred embodiment of a method of making a bullet according to the principles of this invention comprises metal injection molding a bullet preform having a generally cylindrical shape with solid rearward portion, and a hollow forward portion open to the front of the bullet preform. The forward portion of the bullet perform is formed into a tapering configuration with an open front end. The hollow forward portion has a generally cylindrical rearward portion of a first diameter; a generally frustoconical intermediate portion; and a generally cylindrical forward portion of a second diameter, larger that the first diameter. The walls of the generally frustoconical intermediate portion of the cavity have a generally S-shaped configuration. A tip can be disposed in the open forward end of the jacket.

Generally, a third preferred embodiment of a method of making a bullet according to the principles of this invention comprises metal injection molding a bullet preform, the bullet preform having a generally cylindrical shape with solid rearward portion, and a hollow forward portion open to the front of the bullet preform. The hollow is formed by a cavity in the forward portion extending at least 50% of the total length of the preform The forward portion of the bullet perform is formed into a tapering configuration with an open front end. The hollow has a generally widening rearward portion; a generally frustoconical intermediate portion; and a generally widening forward portion of a second diameter, each of the three portions widening toward the front of the preform. The slopes of the rearward and forward portions are less than the slope of the intermediate portion. The walls of the generally frustoconical intermediate portion can have a generally S-shaped configuration. A tip can be disposed in the open forward end of the jacket.

Generally, a fourth preferred embodiment of a method of making a bullet according to the principles of this invention comprises metal injection molding a partition bullet jacket of a first material. The jacket has a partition having a forwardly projecting sidewall forming a forward cup, and a rearwardly projecting sidewall forming a rearward cup. A rear core is inserted tin in the rear cup and at least a portion of the rear cup is deformed to engage the rear core in the rear cup. A forward core is inserted into the forward cup and at least a portion of the forward cup is deformed to form a tapering forward portion of the bullet and engage the forward core therein. The forward cup is formed into the tapering forward portion of the bullet with an open forward end, and a pointed tip is disposed in the open forward end of the jacket. The thickness of the sidewall of the forward cup of the jacket is greater adjacent the partition than adjacent the forward edge of the cup.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
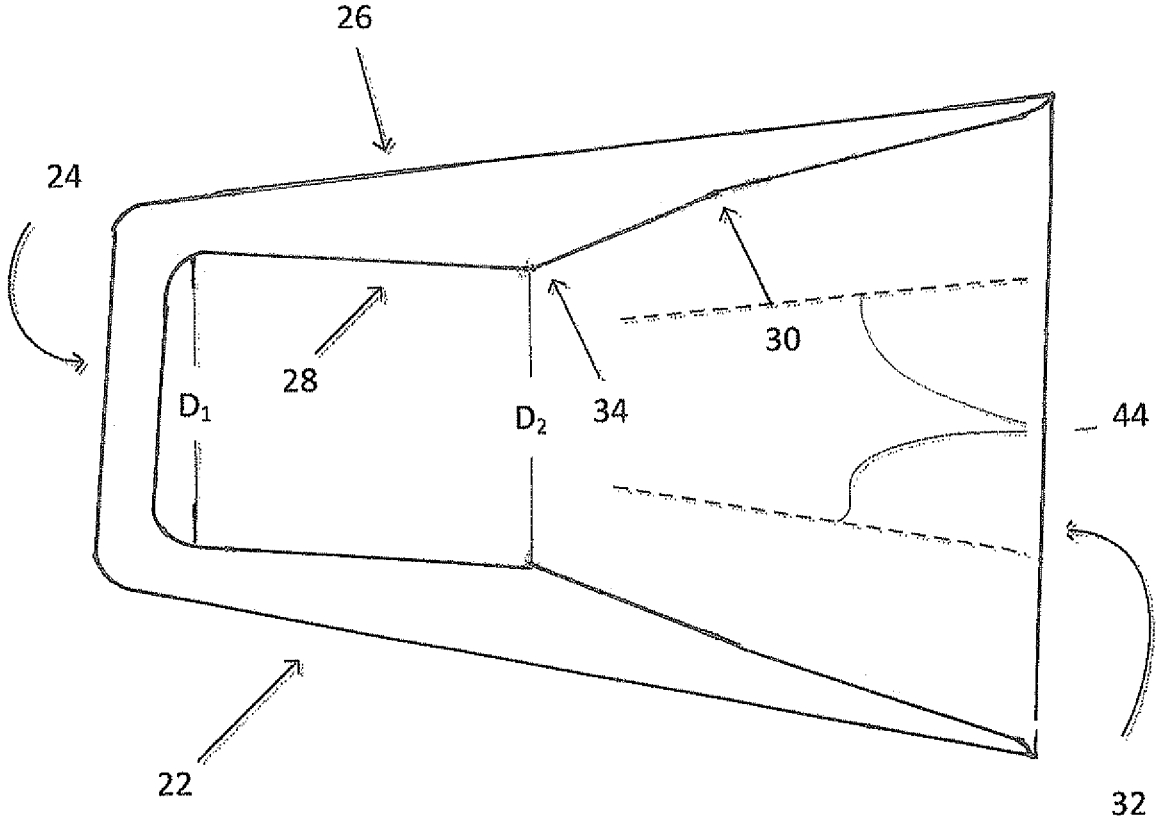
FIG. 1 is a longitudinal cross-sectional view of a jacket preform used in the first preferred embodiment of this invention.
Figure 2:
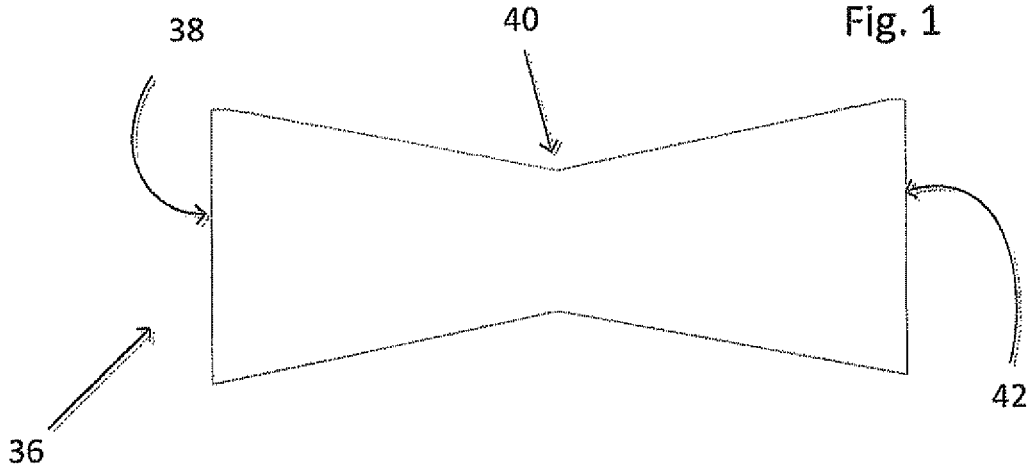
FIG. 2 is a longitudinal cross-sectional view of a core used in the method of the first preferred embodiment.

Generally, a first preferred embodiment of a method of making a bullet according to the principles of this invention comprises metal injection molding a bullet jacket preform 22 of a first material. As shown in FIG. 1, the jacket perform comprises back 24, and a sidewall 26 projecting forwardly and outwardly from the back. The sidewall has a rearward portion 28 adjacent the back 24, and a forward portion 30 adjacent the open front 32. The thickness of the rearward portion 28 of the sidewall 26 increases toward the forward portion 30. The thickness of the forward portion 30 of the sidewall 26 decreases toward the open front 32. This forms a circumferential ridge 34 on the inside side of the sidewall 26 between the rearward portion 28 and the forward portion 30. The outward slope of the sidewall 26 is preferably such that the internal diameter at the ridge 34 is substantially the same as the internal diameter adjacent the back 24 for receiving a core 36, as described below.

The jacket preform 22 is preferably made of a dense but relatively hard material that is readily formable by metal injection molding techniques, for example preferably pure copper powder or copper powder mixtures where mixture would contain up to 35% zinc. The jacket preform could also be made of other metals or metal alloys, for example high performance alloys, lead brasses, tin brasses, phosphor bronzes, cupro-nickels, nickel silvers, steel, stainless steel, aluminum and any other metals/metal alloys appropriate for bullet jacket material.

A core 36, preferably of a material different from the jacket preform, is inserted into the jacket perform 22. The jacket preform 22 is preferably configured so that the diameter $D_2$ adjacent the ridge 34 is substantially the same as the diameter $D_1$ adjacent the back 34, so that rear end 38 of the core 36 sized to substantially fill the cavity formed in the rear of the jacket preform 22 can pass the ridge 34 and firmly seat in the jacket preform. The core 36 preferably has a hour-glass configuration with a narrow waist 40 intermediate the rearward end 38 and the forward end 42.

The jacket perform 22 is mechanically formed around the core 26 to form a bullet with a generally cylindrical rearward portion and a forward portion that tapers toward the forward end, with an open forward end. The waist 40 of the core 36 receives the ridge 34 of the relatively harder jacket preform, engaging the core 36 in the jacket. Alternatively the core could be made substantially cylindrical, of a material that is sufficiently soft to be deformed by the jacket preform. The ridge 34 impinges on the side of the core 36, retaining the core in the jacket. The core is preferably made of a soft (deformable) dense material, such as lead or a lead alloy, or if a lead free bullet is desired the core could be made of copper alloys such as Oxygen Free Copper, Free Machining Copper, Leaded Brass and Zinc.

Preferably, a plurality of lines of weakness 44 are formed in the forward portion 30 of the sidewall 26 of the packet preform 22 during the metal injection molding process. Alternatively these lines of weakness can be formed after the jacket preform 22 has been molded. The line of weakness 44 can be areas of reduced thickness, lines of perforations, or continuous gaps. The lines of weakness 44 facilitate the jacket opening when the bullet hits a target.

A tip 46 can be inserted into the open front of the bullet, frictionally engaged by the open front end of the jacket. The tip improves the ballistic properties of the bullet, and can further help in expanding the bullet when it hits a target.

Figure 3:
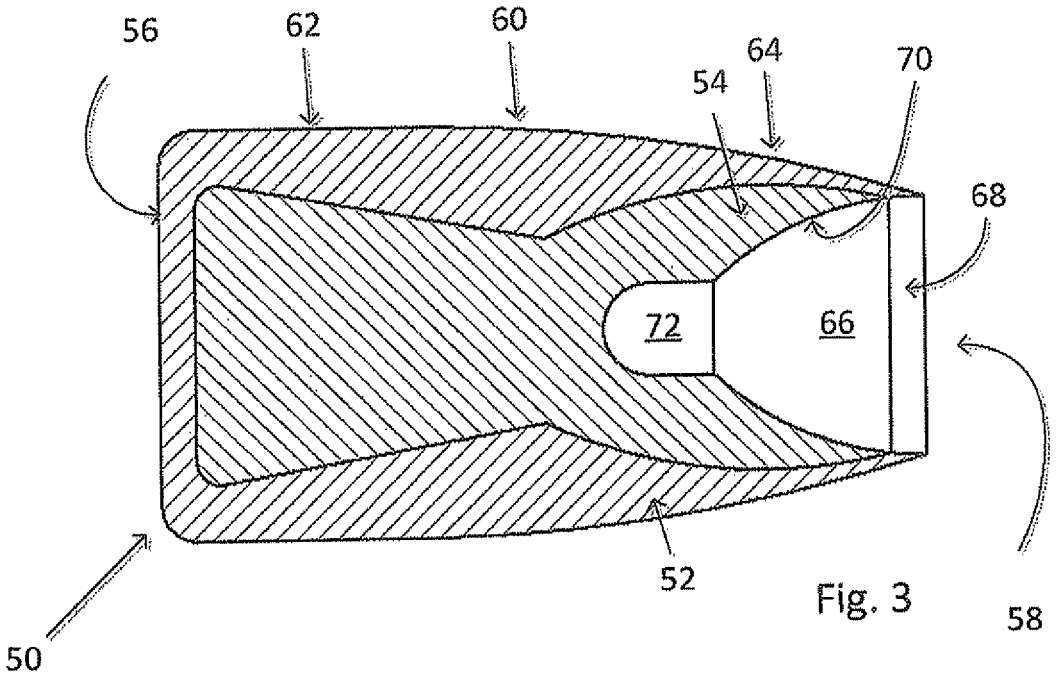
FIG. 3 is a longitudinal cross-sectional view of a bullet made according to the method of the first preferred embodiment.
Figure 4:
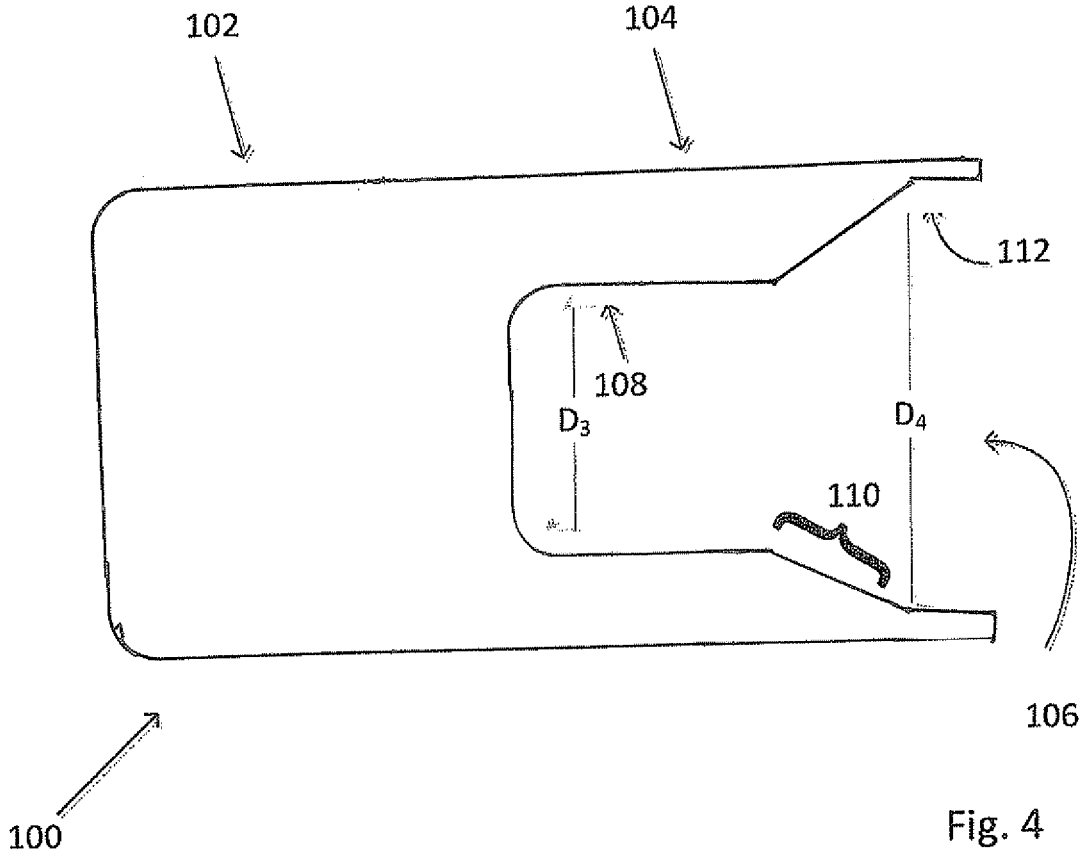
FIG. 4 is a longitudinal cross-sectional view of a bullet preform used in the second preferred embodiment of this invention.

One embodiment of a bullet 50 made from a jacket preform similar to preform 22, is shown in longitudinal cross section in FIG. 3. The jacket preform has been transformed into jacket 52 and the core 36 has been transformed into the bullet core 54 by swaging. The finished bullet 50 has a closed proximal end 56, an open distal end 58, and a sidewall 60 therebetween comprising a generally cylindrical proximal section 62 and a tapering distal section 64. There is a concavely curved recess 66 opening to the open distal end 58. The rim 68 of the recess 66 is formed by the jacket 52, while the interior 70 of the recess is formed in the core 54. There is a concave dimple 72 in the bottom of the recess 66. What was the ridge 34 on the interior of the jacket preform 22 engages what was the waist 40 of the core 36, mechanically engaging the core 54 in the jacket 52. The swaging process that formed the distal portion 30 of the jacket preform 22 into the tapering distal section 64 of the bullet 50 also curved the distal portion of the core 36, and formed the concavely curved recess 66 and the concave dimple 72. The concavely curved configuration of the interior portion of the distal portion of the jacket 52 and the convexly curved exterior portion of the core 54 also help releasably engage the core in the jacket.

Figure 5:
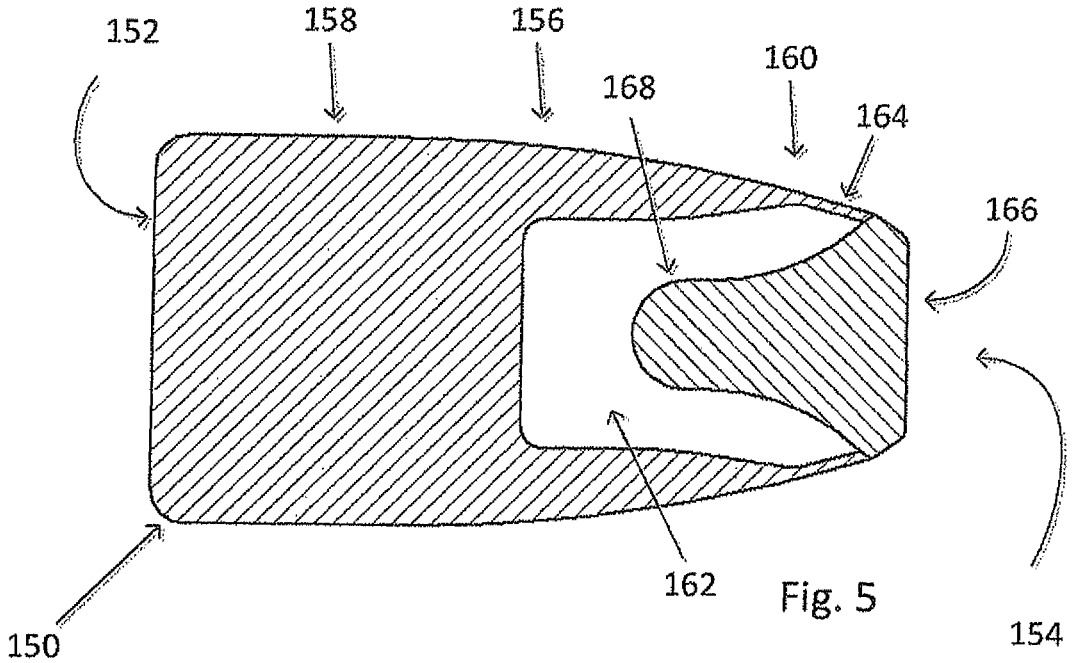
FIG. 5 is a longitudinal cross-sectional view of a bullet made according to the method of the second preferred embodiment.
Figure 6:
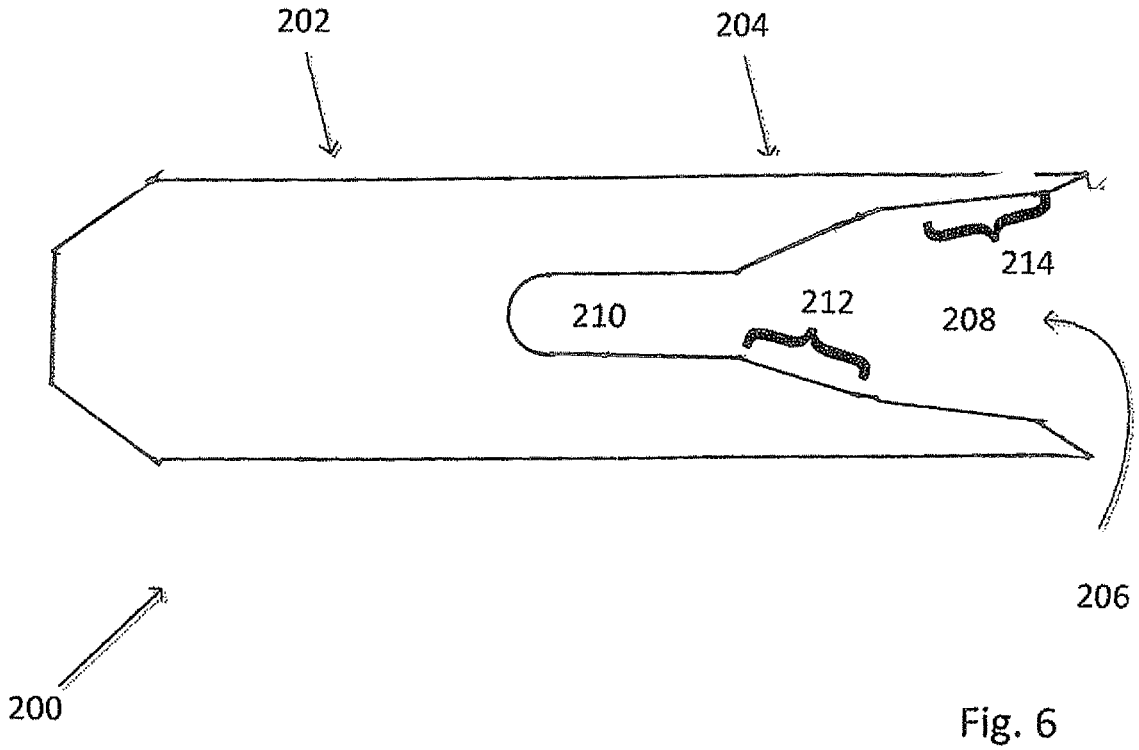
FIG. 6 is a is longitudinal cross-sectional view of a bullet preform used in the second preferred embodiment of this invention.

Generally, a second preferred embodiment of a method of making a bullet according to the principles of this invention comprises metal injection molding a bullet preform 100 having a generally cylindrical shape with solid rearward portion 102, and a hollow forward portion 104 open to the front 106 of the bullet preform. The forward portion 104 of the bullet perform 100 is formed into a tapering configuration with an open front end (FIG. 5). The hollow in the hollow forward portion 104 has a generally cylindrical rearward portion 108 of a first diameter $D_3$; a generally frustoconical intermediate portion 110; and a generally cylindrical forward portion 112 of a second diameter $D_4$, larger that the first diameter. The walls of the generally frustoconical intermediate portion 110 of the cavity can have a generally S-shaped configuration. The bullet preform 100 is preferably made of copper, or a copper alloy material such as Oxygen Free Copper, Free Machining Copper, Leaded Brasses and Zinc.

A core (not shown) could be disposed in the hollow forward portion 104 before the bullet is formed, but the preform 100 is particularly suited for making solid, hollow point bullets. Lines of weakness (not shown) can also be formed in the walls of the hollow forward portion, to facilitate expansion of the bullet upon hitting a target. Finally, a tip 114 can be disposed in the open forward end of the bullet to improve the ballistic properties of the bullet, and can further help in expanding the bullet when it hits a target.

One embodiment of a bullet 150 made from a bullet preform similar to preform 100, is shown in longitudinal cross section in FIG. 5. The finished bullet 150 has closed proximal end 152, a capped distal end 154, and a sidewall 156 therebetween comprising a generally cylindrical proximal section 158 and a tapering distal section 160. There is a cavity 162 in the distal end of the bullet 150, The jacket preform defines a thin-walled rim 164 around the opening of the cavity 162. A tip 166 is engaged in the opening defined by the rim 164. The blunt tip 166 has a substantially flat distal surface, and a proximally extending protuberance extending into the cavity 162. The distal portion 160, cavity 162 and rim 164 of the bullet 150 are formed by a swaging process.

Generally, a third preferred embodiment of a method of making a bullet according to the principles of this invention comprises metal injection molding a bullet preform 200, the bullet preform having a generally cylindrical shape with solid rearward portion 202, and a hollow forward portion 204 open to the front 206 of the bullet preform. The hollow is formed by a cavity 208 in the forward portion 204 extending at least 50% of the total length of the preform 200. The cavity has a generally widening rearward portion 210; a generally frustoconical intermediate portion 212; and a generally widening forward portion of a second diameter 214, each of the three portions widening toward the front 206 of the preform. The slopes of the rearward 210 and forward portions 214 are less than the slope of the intermediate portion 212. The walls of the generally frustoconical intermediate portion 212 can have a generally S-shaped configuration. The forward portion of the bullet perform is formed into a tapering configuration with an open front end. A tip 216 can be disposed in the open forward end of the bullet.

The bullet preform 200 is preferably made of copper, or a copper alloy material such as Oxygen Free Copper, Free Machining Copper, Leaded Brasses and Zinc.

Figure 7:
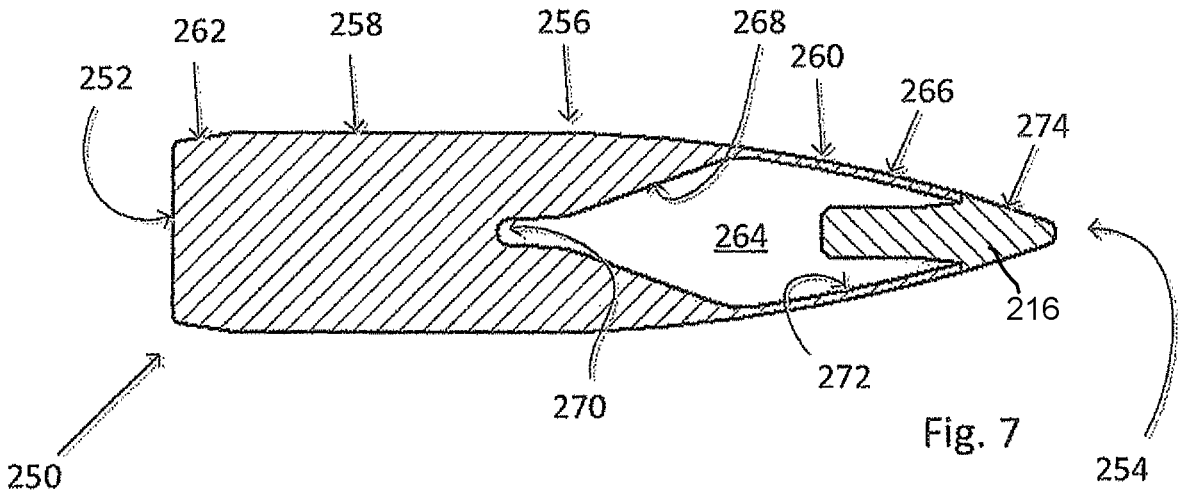
FIG. 7 is a longitudinal cross-sectional view of a bullet made according to the method of the second preferred embodiment.
Figure 8:
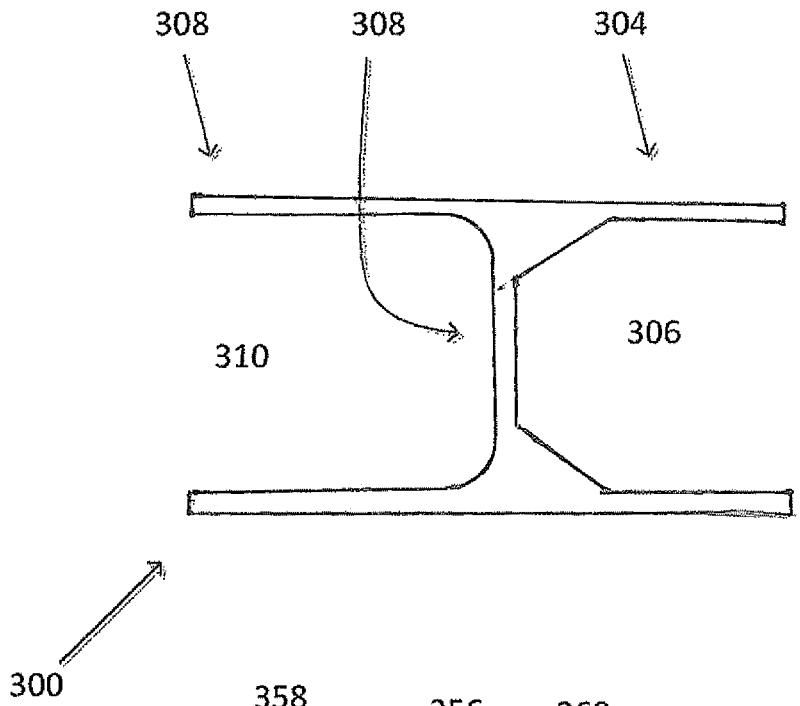
FIG. 8 is a longitudinal cross-sectional view of a partitioned bullet jacket used in the second preferred embodiment of this invention.

One embodiment of a bullet 250 made from a bullet preform similar to preform 200, is shown in longitudinal cross section in FIG. 7. The finished bullet 250 has closed proximal end 252, a capped distal end 254, and a sidewall 256 therebetween comprising a generally cylindrical proximal section 258 and a tapering distal section 260. The proximal end of the bullet 250 can have boat tail configuration 262. There is a cavity 264 in the distal end of the bullet 250, The bullet preform defines a thin-walled rim 266 around the opening of the cavity 264. The cavity 264 has a tapering proximal wall 268, leading to a steep walled well 270, and tapering distal wall 272 tapering toward to the distal opening. A tip 274 is engaged in the distal opening defined by the rim 266. The tip 274 comes to a point to improve the aerodynamic properties of the bullet, 250, and has a proximally extending stem extending into the cavity 264. The distal portion 260, cavity 264 and rim 266 are formed by a swaging process.

Generally, a fourth preferred embodiment of a method of making a bullet according to the principles of this invention comprises metal injection molding a partition bullet jacket 300 of a first material. The jacket 300 has a partition 302 having a forwardly projecting sidewall 304 forming a forward cup 306, and a rearwardly projecting sidewall 308 forming a rearward cup 310. A rear core 312 is inserted tin in the rear cup 310 and at least a portion of the rear cup (e.g., the rearwardly projecting sidewall 308) is deformed to engage the rear core in the rear cup. A forward core 314 is inserted into the forward cup 306 and at least a portion of the forward cup 306 is deformed to form a tapering forward portion 316 of the bullet and engage the forward core therein. The forward cup 306 is preferably formed into the tapering forward portion of the bullet with an open forward end, and a pointed tip 318 is disposed in the open forward end of the jacket. The thickness of the forwardly projecting sidewall 304 of the forward cup 306 is greater adjacent the partition 302 than adjacent the forward edge of the cup 306.

The jacket preform 300 is preferably made of a dense but relatively hard material that is readily formable by metal injection molding techniques, for example preferably pure copper powder or copper powder mixtures where mixture would contain up to 35% zinc. The jacket preform could also be made of other metals or metal alloys, for example high performance alloys, lead brasses, tin brasses, phosphor bronzes, cupro-nickels, nickel silvers, steel, stainless steel, aluminum and any other metals/metal alloys appropriate for bullet jacket material. The cores 312 and 314 are preferably made of a soft (deformable) dense material, such as lead or a lead alloy, or if a lead free bullet is desired the core could be made of material such as Oxygen Free Copper, Free Machining Copper, Leaded Brasses and Zinc. The cores 312 and 314 may be made of the same materials or they can be made of different materials.

Figure 9:
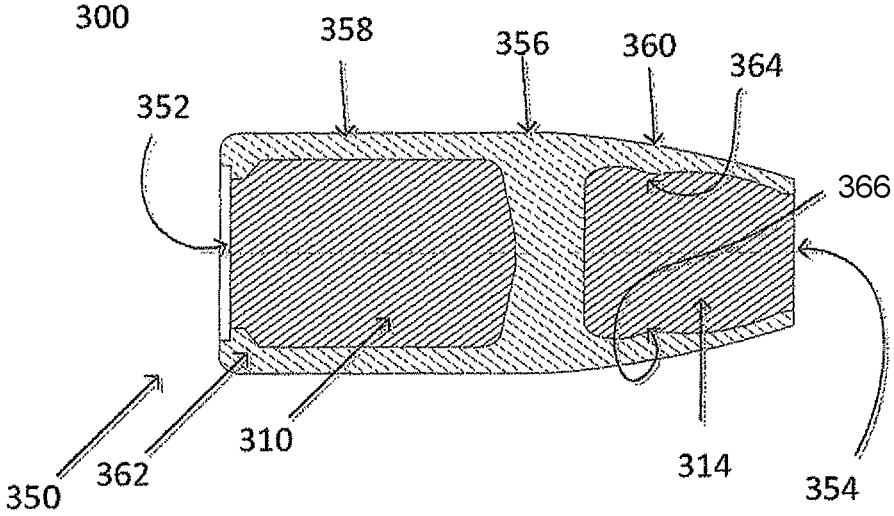
FIG. 9 is a longitudinal cross-sectional view of a bullet made according to the method of the fourth preferred embodiment.

One embodiment of a bullet 350 made from a jacket preform similar to preform 300, is shown in longitudinal cross section in FIG. 9. The finished bullet 350 has an open proximal end 352, and an open distal end 354, and a sidewall 356 therebetween comprising a generally cylindrical proximal section 358 formed by the rearwardly projecting sidewall 308 of the jacket preform 300, and a tapering distal section 360 formed by the forwardly projecting sidewall 304 of the jacket preform. The proximal end of the rearwardly projecting sidewall 308 is formed into a lip or rim 362 that engages the core 310, retaining it in place. The forwardly projecting sidewall 304 of the jacket preform and core 314 are deformed, such as by swaging to for the tapering portion 260 of the sidewall of bullet 350. This tapering configuration helps to engage core 314 in the jacket. A rib 364 can be formed on the inside surface of the forwardly projecting wall 304, to form and/or engage a corresponding valley 366 in the core 314, to further secure the core in bullet. The rib can be formed during the swaging process, or it can be formed in the cup 306 of the jacket preform 306.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A method of making a solid bullet comprising: metal injection molding a bullet preform, the bullet preform having a generally cylindrical shape with a solid rearward portion, and a hollow forward portion open to the front of the bullet preform, the hollow forward portion being formed by a cavity in the forward portion extending at least 50% of the total length of the preform; wherein the cavity has a generally widening rearward portion, a generally frustoconical intermediate portion, and a generally widening forward portion of a different diameter than the rearward portion, each of the three portions of the cavity widening toward the front of the preform, the slopes of the rearward and forward portions of the cavity being less than the slope of the intermediate portion; and shaping the hollow forward portion of the bullet preform into a tapering configuration with an open forward end.

2. The method according to claim 1 further comprising disposing a pointed tip in the open forward end of the shaped preform.

3. The method according to claim 1 wherein the walls of the cavity of the preform have a generally S-shaped configuration.

* * * * *